US006666111B1

(12) United States Patent
Hsien

(10) Patent No.: US 6,666,111 B1
(45) Date of Patent: Dec. 23, 2003

(54) WRENCH TEETH ARRANGEMENT FOR RATCHET TOOLS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/331,470

(22) Filed: Dec. 31, 2002

(51) Int. Cl.[7] ..... B25B 13/46
(52) U.S. Cl. ..... 81/60; 81/58
(58) Field of Search ..... 81/60–63.2, 58

(56) References Cited

U.S. PATENT DOCUMENTS 810,599 A * 1/1906 Ansorge ..... 81/60
4,991,468 A * 2/1991 Lee ..... 81/60
5,783,286 A * 7/1998 DiNicola ..... 428/188
6,205,889 B1 * 3/2001 Hsieh ..... 81/60

* cited by examiner

*Primary Examiner*—Hadi Shakeri
(74) *Attorney, Agent, or Firm*—Rosenberg, Klein & Lee

(57) ABSTRACT

A ratchet wrench includes a head with a hole and an engaging ring is rotatably engaged with the hole. The engaging ring has first teeth defined in an outer periphery thereof and a pawl is movably received in a side hole in the head. The pawl has second teeth which are engaged with the first teeth of the engaging ring. A distance between two adjacent first teeth is twice the distance of two adjacent second teeth.

3 Claims, 10 Drawing Sheets

WRENCH TEETH ARRANGEMENT FOR RATCHET TOOLS

FIELD OF THE INVENTION

The present invention relates to a wrench that has an engaging ring with 90 to 180 teeth so that the wrench outputs torque within a small angle of rotation.

BACKGROUND OF THE INVENTION

A conventional wrench generally includes a head with an aperture with which an engaging ring is engaged. The engaging ring includes a polygonal hole so as to mount onto a nut or a bolt head. A pawl is movably received in the head and engaged with the teeth defined in an outer periphery of the engaging ring such that the engaging ring can be maintained stationary relative to the rotation of the wrench, or co-rotatable with the rotation of the wrench. Nevertheless, there is a gap between the teeth of the engaging ring and the pawl so that when the wrench is rotated a small angle the teeth of the engaging ring do not match with the pawl. Therefore, when the wrench is used in a narrow space which allows the wrench to be rotated only a limited angles, no torque can be exerted on the object to be tightened or loosened.

The present invention intends to provide a wrench which has an engaging ring with 90 to 180 teeth so as to response any angle of rotation of the wrench.

SUMMARY OF THE INVENTION

In accordance with one aspect of the present invention, there is provided a ratchet wrench includes an engaging ring rotatably engaged with a hole in the head and the engaging ring has first teeth defined in an outer periphery thereof so as to be engaged with second teeth of a pawl movably received in a side hole in the head. A distance between two adjacent second teeth of the pawl is twice the distance of two adjacent first teeth of engaging ring.

The primary object of the present invention is to provide a wrench that is able to output a torque within a small angle of rotation.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
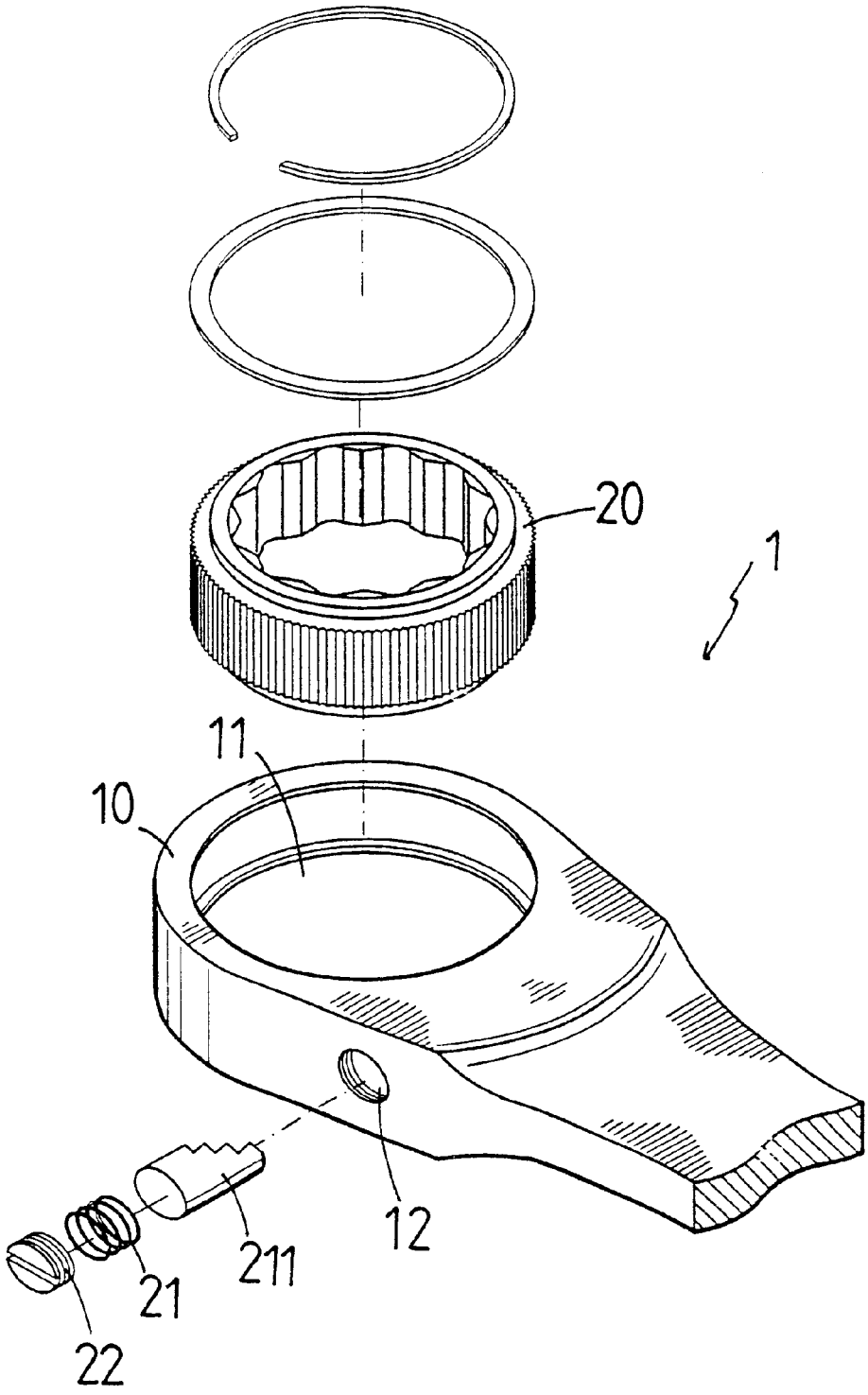
FIG. 1 is an exploded view to show a ratchet wrench.
Figure 2:
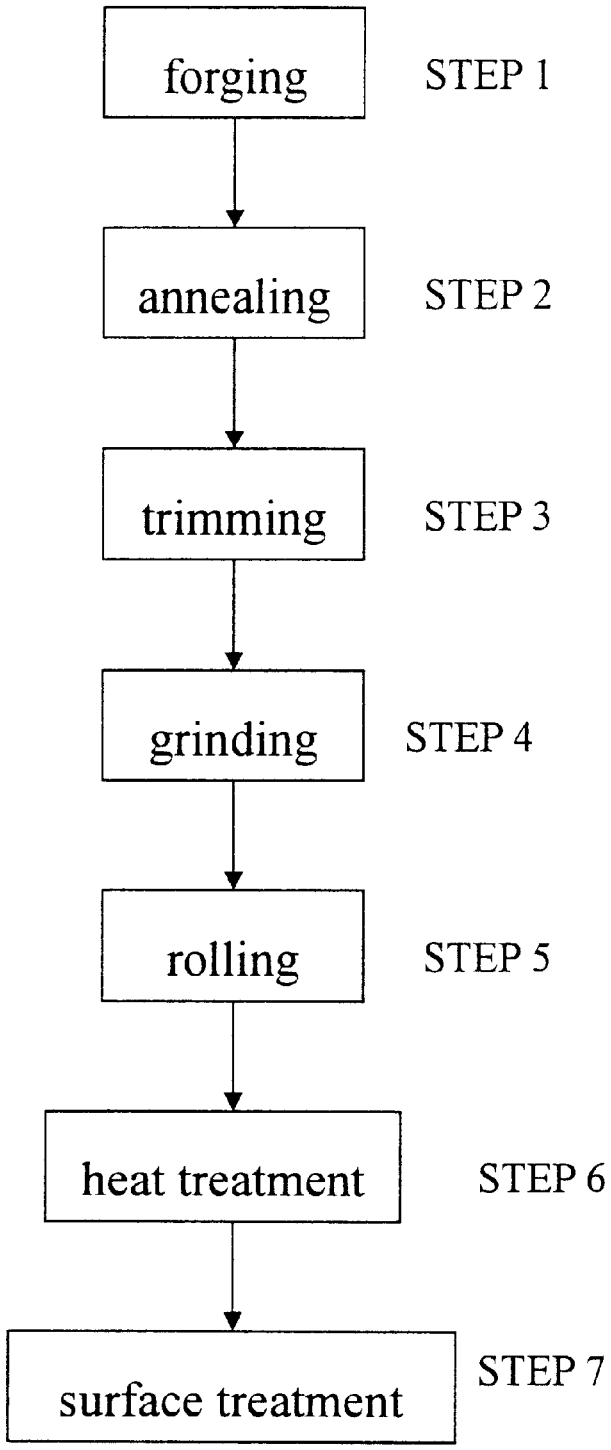
FIG. 2 shows steps of method for making the engaging ring with 90–180 teeth.

Referring to FIGS. 1, 8, 9A and 9B, the ratchet wrench 1 of the present invention comprises a head 10 with a hole 11 defined therethrough and an engaging ring 20 is rotatably engaged with the hole 11. The engaging ring 20 has first teeth defined in an outer periphery thereof and a polygonal inner periphery for being engaged with a polygonal object such as a nut (not shown). A side hole 12 is defined in the head 10 and communicates with the hole 11. A pawl 211 is movably received in the side hole 12 and has second teeth which are engaged with the first teeth of the engaging ring 20. The side hole 12 is sealed by a bolt 22 and a spring 21 is biased between the bolt 22 and the pawl 211. A distance between two adjacent second teeth of the pawl 211 is twice the distance of two adjacent first teeth of the engaging ring 20. This arrangement ensures that the first teeth are engaged with the second teeth even if the ratchet wrench 1 is rotated only a small angle. Therefore, the ratchet wrench 1 can be used in a narrow space.

Referring to FIGS. 10, 11, 12A and 12B, the ratchet tool can also be made to have the engaging ring 20' have first teeth such as 72 teeth and the pawl 212 has second teeth, wherein a distance between two adjacent first teeth of the engaging ring 20' is twice the distance of two adjacent second teeth of the pawl 212.

Referring to FIGS. 2 to 7, the engaging ring 20 can be made by the following steps which are:

step 1: forging;

step 2: annealing;

step 3: trimming:

step 4: grinding:

step 5: rolling:

step 6: heat treatment; and step 7: surface treatment.

Figure 3:
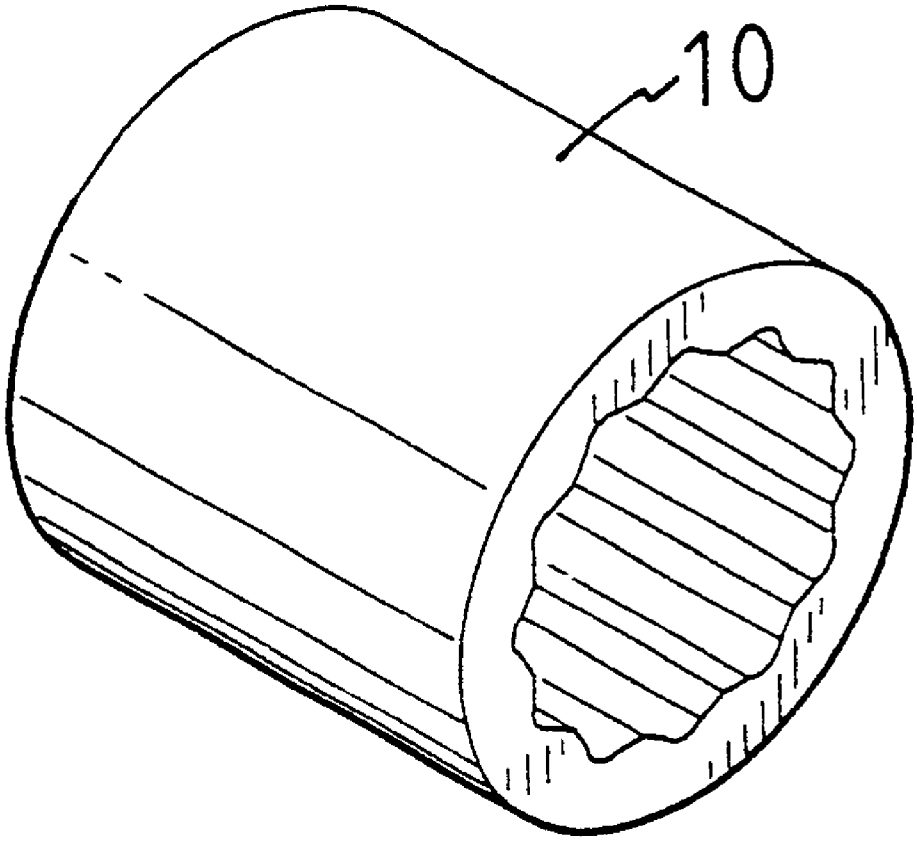
FIG. 3 shows the initial product of the engaging ring.
Figure 4:
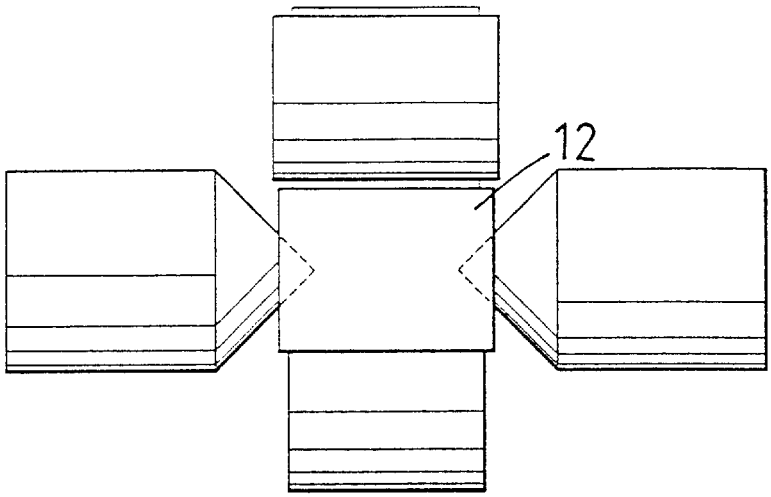
FIG. 4 shows the initial product of the engaging ring is proceeded by way of center grinding.
Figure 5:
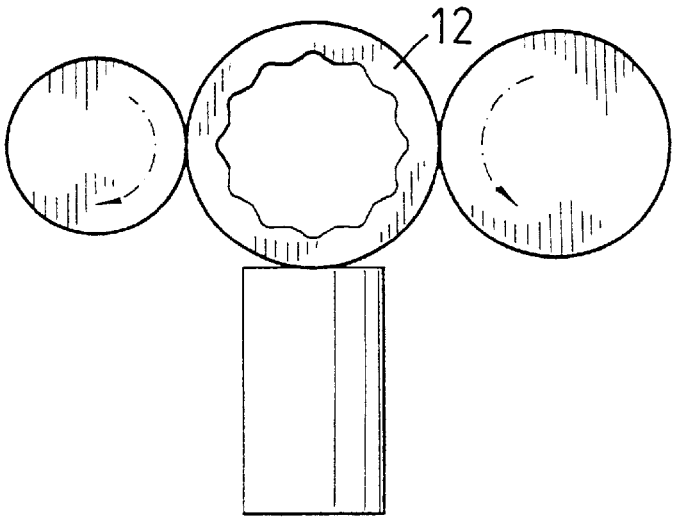
FIG. 5 shows the initial product of the engaging ring is proceeded by way of centerless grinding.

An initial product of the engaging ring 10 is made in step 1 as shown in FIG. 3 and the initial product of the engaging ring 10 is then proceed by annealing twice preferably. The initial product of the engaging ring 10 is then trimmed by using a lather and ground by way of center grinding or centerless grinding so as to obtain a precision of $1\mu$ to $5\mu$ as shown in FIGS. 4 and 5.

Figure 6:
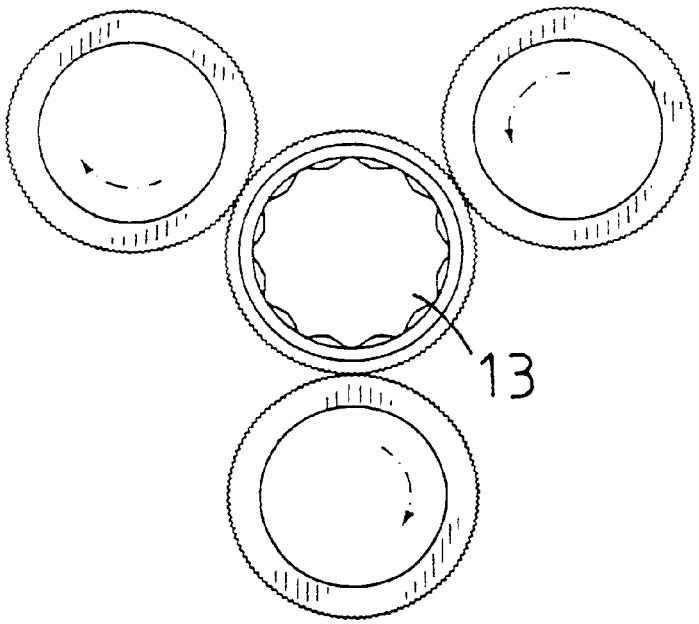
FIG. 6 shows the initial product of the engaging ring is proceeded by way of rolling.
Figure 7:
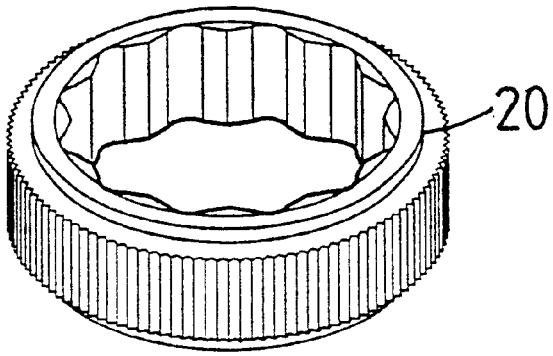
FIG. 7 is a perspective view to show the final product of the engaging ring.
Figure 8:
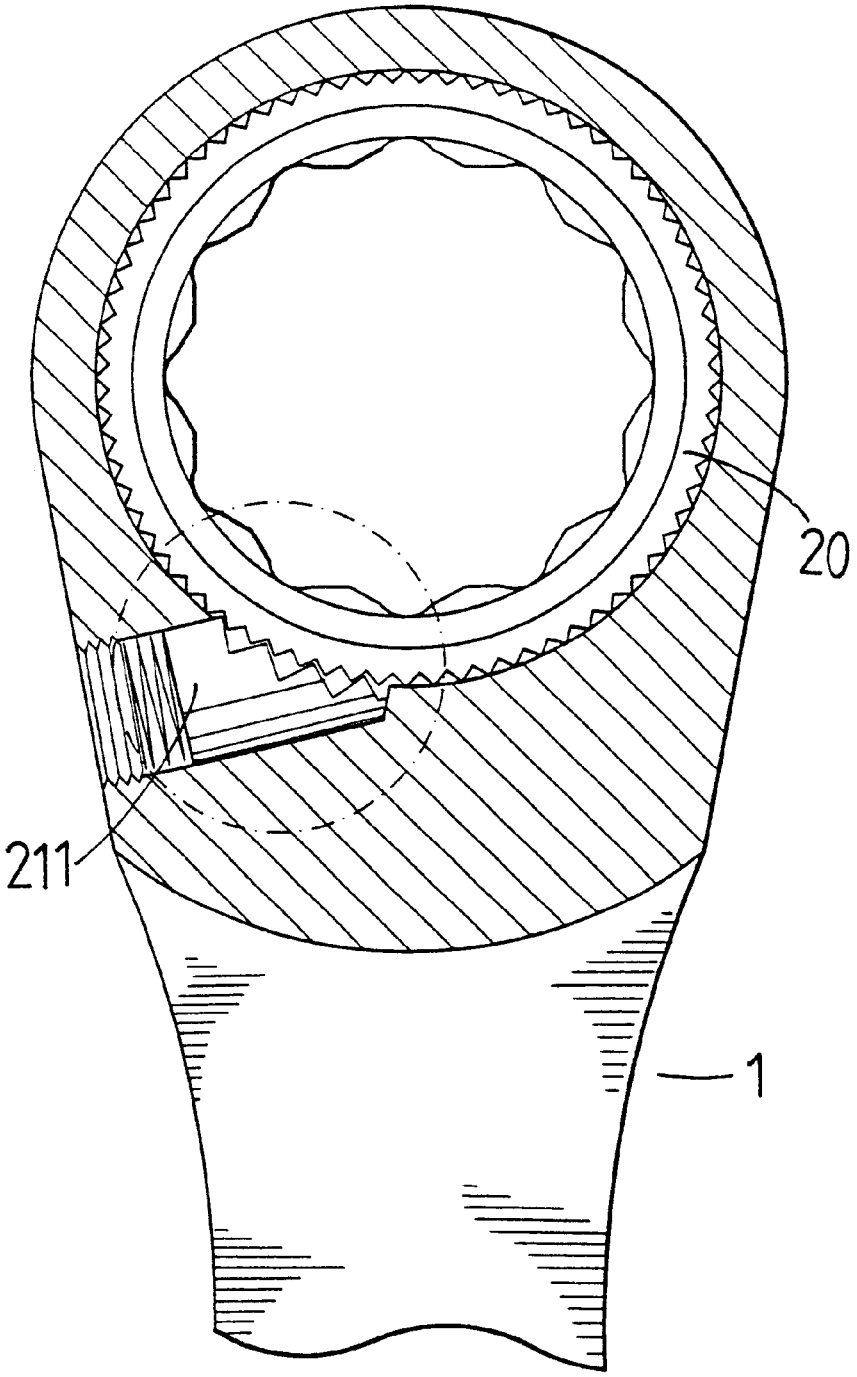
FIG. 8 is a cross sectional view to show the ratchet tool.
Figure 9A:
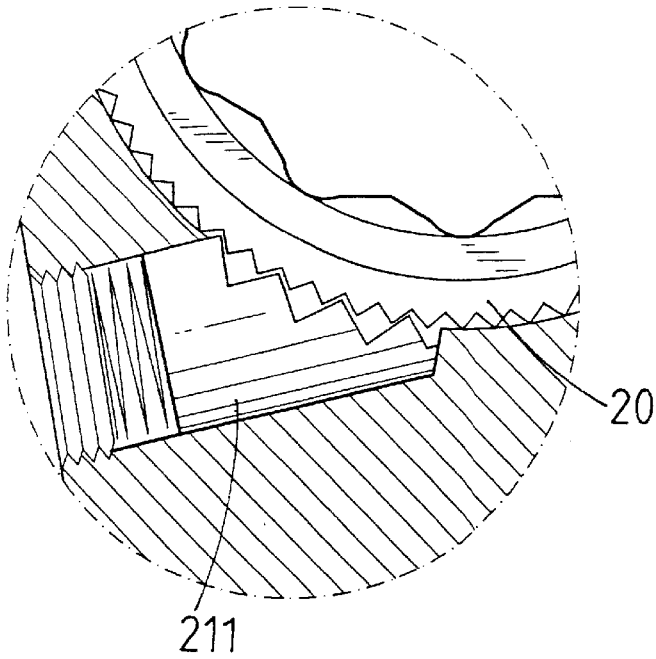
FIG. 9A shows that the second teeth of the pawl are engaged with the first teeth of the engaging ring.
Figure 9B:
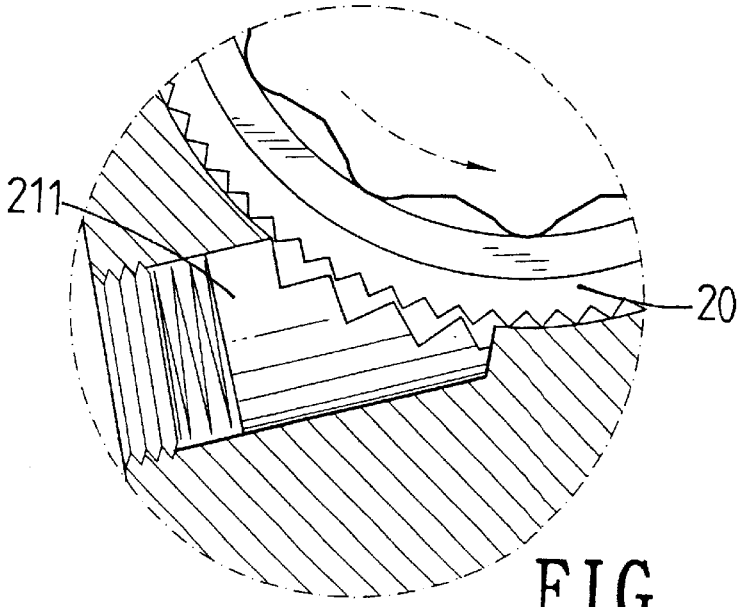
FIG. 9B shows that the second teeth of the pawl are disengaged from the first teeth of the engaging ring.
Figure 10:
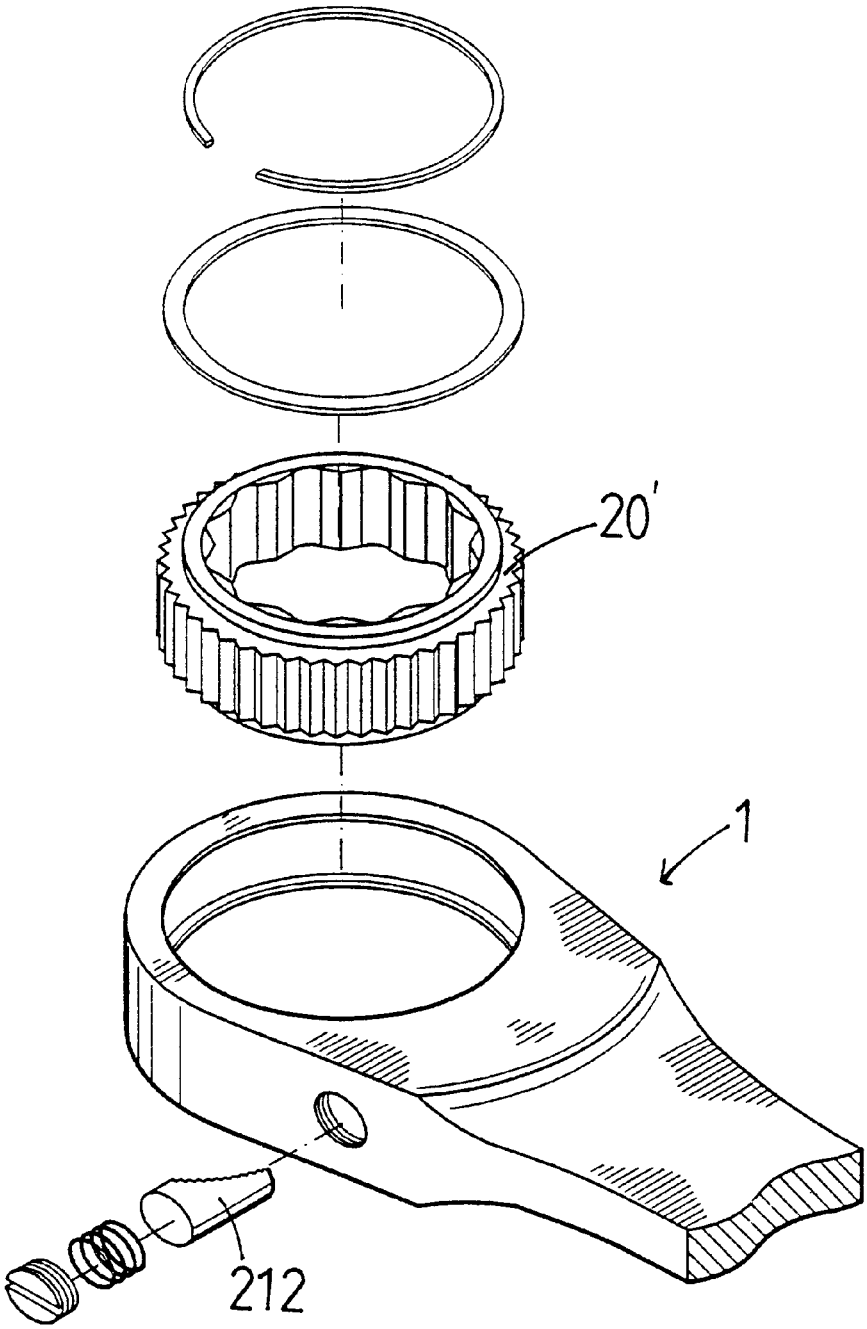
FIG. 10 is an exploded view to show another embodiment of the ratchet wrench of the present invention.
Figure 11:
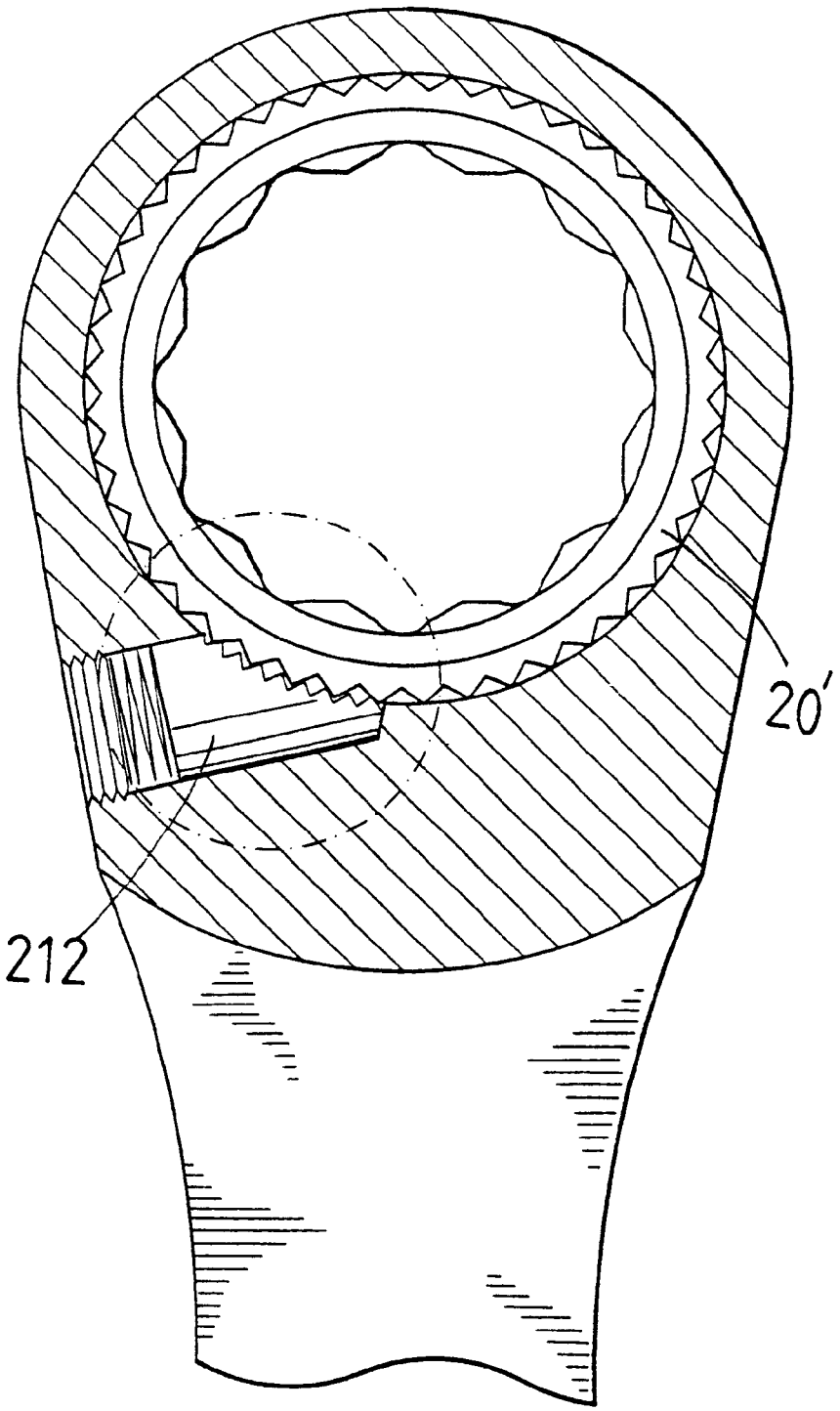
FIG. 11 is a cross sectional view to show the ratchet tool as shown in FIG. 10.
Figure 12A:
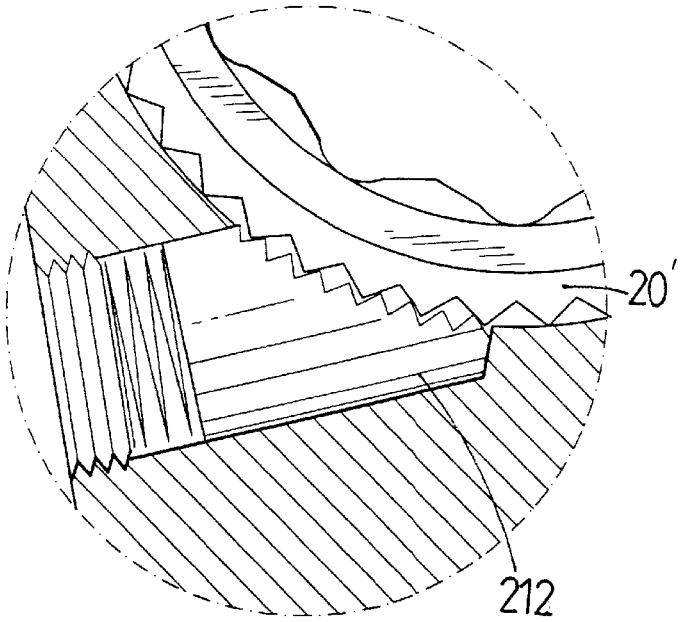
FIG. 12A shows that the second teeth of the pawl are engaged with the first teeth of the engaging ring of the embodiment shown in FIG. 10.
Figure 12B:
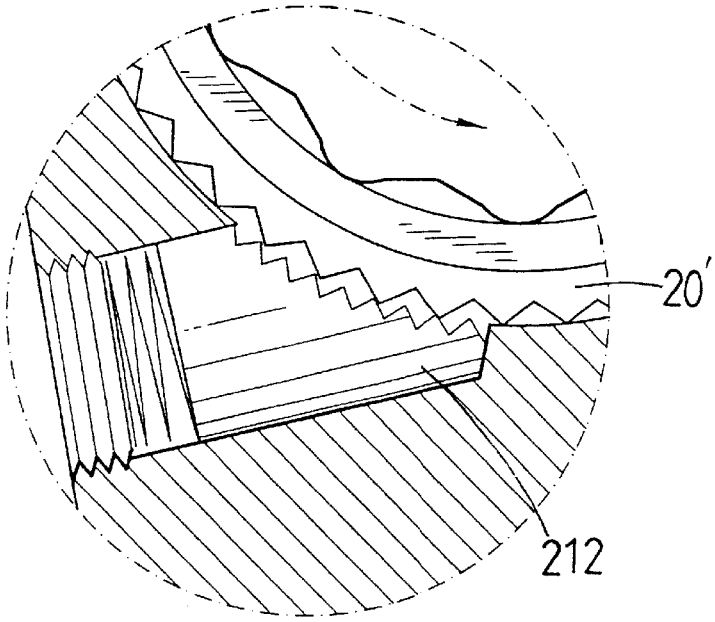
FIG. 12B shows that the second teeth of the pawl are disengaged from the first teeth of the engaging ring of the embodiment shown in FIG. 10.

A second initial product of the engaging ring 13 is made to have 90 to 180 teeth as shown in FIG. 6. The second initial product of the engaging ring 13 is then proceeded through step 6 and step 7 to obtain the final product.

While we have shown and described the embodiment in accordance with the present invention, it should be clear to those skilled in the art that further embodiments may be made without departing from the scope of the present invention.

What is claimed is:

1. A ratchet wrench comprising:

a head with a hole defined therethrough and an engaging ring rotatably engaged with the hole, the engaging ring having first teeth defined in an outer periphery thereof, a side hole defined in the head and communicating with the hole, a pawl movably received in the side hole and having second teeth which are engaged with the first teeth of the engaging ring, each of said first and second teeth being defined by two sides intersecting at an apex, a distance between two adjacent first teeth apices being half a distance of two adjacent second teeth apices.

2. The wrench as claimed in claim 1, wherein a number of the first teeth is in a range of 90 to 180.

3. A ratchet wrench comprising:

a head with a hole defined therethrough and an engaging ring rotatably engaged with the hole, the engaging ring having first teeth defined in an outer periphery thereof and a polygonal inner periphery, a side hole defined in the head and communicating with the hole, a pawl movably received in the side hole and having second teeth on a distal end thereof, the pawl being biased into engagement with the first teeth of the engaging ring, each of said first and second teeth being defined by two sides intersecting at an apex, a distance between two adjacent first teeth apices being twice a distance of two adjacent second teeth apices.

* * * * *